US005212053A

United States Patent [19]

McSweeney et al.

[11] Patent Number: 5,212,053

[45] Date of Patent: May 18, 1993

[54] TRANSLUCENT DISPLAY PAPER FOR REAR ILLUMINATION

[75] Inventors: Gary J. McSweeney, Hilton; John F. Bacilek; John H. Goselin, both of Rochester, all of N.Y.

[73] Assignee: Eastman Kodak Company, Rochester, N.Y.

[21] Appl. No.: 832,826

[22] Filed: Feb. 7, 1992

[51] Int. Cl.[5] ..... G03C 1/46

[52] U.S. Cl. ..... 430/503; 430/538; 430/536; 430/505; 430/510

[58] Field of Search ..... 430/538, 536, 505, 510, 430/503

[56] References Cited

U.S. PATENT DOCUMENTS

| | | | |
|---|---|---|---|
| 2,327,380 | 8/1943 | Toland et al. | 430/538 |
| 2,805,160 | 9/1957 | Griggs et al. | 430/538 |
| 3,260,602 | 7/1966 | Wood et al. | 430/538 |
| 3,813,261 | 5/1974 | Muller | 430/538 |
| 4,049,454 | 9/1977 | Van Doorselaar et al. | 430/505 |
| 4,103,072 | 7/1978 | Valentine | 428/425 |
| 4,288,287 | 9/1981 | Miyama et al. | 430/538 |
| 4,312,937 | 1/1982 | Kasper et al. | 430/538 |
| 4,352,861 | 10/1982 | von Meer et al. | 430/538 |
| 4,668,611 | 5/1987 | Nakamura | 430/507 |
| 4,876,170 | 10/1989 | Tamagawa et al. | 430/538 |
| 4,977,070 | 12/1990 | Winslow | 430/510 |
| 4,981,774 | 1/1991 | Tai et al. | 430/510 |
| 4,990,432 | 2/1991 | Komatsu et al. | 430/538 |
| 5,104,722 | 4/1992 | Kojima et al. | 430/538 |

*Primary Examiner*—Charles L. Bowers, Jr.
*Assistant Examiner*—Thomas R. Neville
*Attorney, Agent, or Firm*—Paul A. Leipold

[57] ABSTRACT

The invention is generally accomplished by forming a translucent display material comprising a substrate and sensitized layers wherein said substrate comprises a paper that has a light transmission rate of greater than 17 percent. It is preferred that the paper have a basis weight of less than 120 grams per square meter that is resin-coated on both sides. The paper of the invention when exposed and developed has a difference between maximum density and minimum density of greater than 2.5. The sensitized layers prior to imaging comprise at least one layer comprising cyan dye-forming coupler, at least one layer comprising magenta dye-forming coupler, and at least one layer comprising yellow dye-forming coupler. In preferred forms, the paper has a basis weight of between 70 and 100 grams per square meter for a balance of translucence and strength. The couplers preferably are present in the following amounts: cyan coupler greater than 0.6 grams per square meter, magenta coupler greater than 0.6 grams per square meter, and yellow coupler in an amount greater than 0.6 grams per square meter.

10 Claims, No Drawings

TRANSLUCENT DISPLAY PAPER FOR REAR ILLUMINATION

TECHNICAL FIELD

This invention relates to backlighted photographic display materials.

BACKGROUND ART

It is known in the art that display materials may be formed for backlighting displays such as those utilized in backlighted display materials for advertising, as well as backlighted decorative displays of photographs. These materials generally are formed on a sheet of polyester which maintains the material rigidly and without wrinkles for display in the backlighted unit. These materials, while successful, have the disadvantage that they are relatively expensive in that the polyester backing material is expensive and the adjustment of the apparatus utilized for laying down sensitized photographic materials to handle rigid display materials is expensive and time-consuming.

It is known that photographic materials may be placed onto resin coated papers, as this is the most common way for photographs to be displayed. However, resin-coated papers commonly utilized are relatively thick and not particularly translucent.

There are backlighted displays such as those used in bus stops and other areas where low cost backlighted advertising is desired. Lithographic prints on paper are now used for low cost backlighted displays However, these prints are not of photographic quality. Further, if backlighted materials were not so expensive, the use of these materials in advertising could be normally expanded. For instance, the lighting in buses could be through such low cost advertising material, rather than being poster style advertising.

DISCLOSURE OF THE INVENTION

It is an object of this invention to provide low cost translucent photographic materials.

It is another object of this invention to provide translucent backlighted display materials that may be formed utilizing conventional color photographic paper-forming apparatus.

These and other objects of the invention are generally accomplished by forming a translucent display material comprising a substrate and sensitized layers wherein said substrate comprises a paper that has a light transmission of greater than 17 percent. It is preferred that the paper have a basis weight of less than 120 grams per square meter and is resin-coated on both sides. The paper of the invention when exposed and developed has a difference between maximum density and minimum density of greater than 2.5. The sensitized layers prior to imaging comprise at least one layer comprising cyan dye-forming coupler, at least one layer comprising magenta dye-forming coupler, and at least one layer comprising yellow dye-forming coupler In preferred forms, the paper has a basis weight of between 70 and 100 grams per square meter for a good balance of translucence and strength. The couplers preferably are present in the following amounts cyan coupler greater than 0.6 grams per square meter, magenta coupler greater than 0.6 grams per square meter, and yellow coupler in an amount greater than 0.6 grams per square meter.

MODES FOR CARRYING OUT THE INVENTION

The invention has numerous advantages over prior products. Prior translucent display materials were expensive and difficult to manufacture. In contrast, the material of the instant invention may be formed on conventional photographic paper-forming machines using conventional techniques. Further it has been surprisingly found that such materials when placed in backlighted display cases are brilliant when viewed. The invention materials also are surprisingly satisfactory for daylight viewing when not backlighted. These and other advantages of the invention will be apparent from the description below.

The invention display paper is formed of a resin-coated paper of a basis weight that is generally less than about 120 grams per square meter, prior to resin coating. It has been found to be preferred that the paper have a basis weight, prior to resin coating, of between 70 and 100 for best light transmission while still providing sufficient strength for the display material. The resin coating is applied on both sides of the paper and may be loaded with conventional optical brighteners and pigments as is conventional in color paper. It has been found surprisingly that the polyethylene resins when coated on the low basis weight paper result in a generally translucent, strong, and waterproof material that will allow the passage of light to a great enough degree to allow brilliant photographs to be viewed with backlighting.

The resin coated paper and white areas of the sensitized, imaged, and developed display paper have a light transmission of greater than 17 percent. It is preferred that transmission be greater than 25 percent for best viewed images. The removal, partial or complete, of optical brighteners and pigments such as $TiO_2$ in the resin layers would give, it is believed, a more translucent product, but also a somewhat less sharp image. The pigment also acts somewhat to lessen the paper structure apparent in white areas of prints.

In the backlighted display paper of the invention silver and coupler laydowns are at a level such that the difference in density, measured in transmission mode with status A densitometry, between the maximum and minimum densities obtainable in each dye-forming layer, is greater than 2.5 where density, D, is defined as $$D = \log 1/T$$

where T=intensity of transmitted light/intensity of incident light. Reference may be made to *Theory of the Photographic Process*, 4th Edition, Editor T. H. James, McMillan, New York, 1977, page 521, and *Reproduction of Color*, 3rd Edition, R. G. Hunt, Fountain Press, England, 1975, page 240, for a fuller description of the measurement technique. Greater than 2.5 density difference is preferred for bright images with good contrast when backlighted.

Paper for use in the invention is selected to have a uniform formation allowing uniform light transmission with minimum paper structure visible. The preferred paper is of hardwood, refined to have short fibers (0.5–0.7 mm weighted fiber length average). Natural hardwood fiber papers are preferred for cost and compatibility with existing photographic processes. However, resin coated artificial papers of polymer fibers, voided polymers, or fiberglass also could be used. Such materials, it is believed, would have good light transmission as such fibers often become invisible when resin coated and impregnated.

The emulsions placed on conventional reflection viewed paper have been found to provide sufficient color rendition for pleasing backlighted photographs when increased amounts of conventional couplers are used. The couplers are provided in much greater amounts than used for conventional reflection color papers. The couplers are preferably used in about twice the amount used for reflection viewed color paper. Generally it has been found that the preferred amount of magenta coupler is between about 0.7 and 1.5 grams per square meter, the amount of yellow dye-forming couplers between the amount of 1.2 and 2.0 grams per square meter and the amount of cyan dye-forming couplers between the amount of 0.7 and 1.5 grams per square meter for particularly pleasing backlighted color rendition. The couplers used may be any of the conventional color couplers utilized in color papers.

The translucent backlight display paper of the invention generally is provided with an overcoat material and UV absorbers to minimize the damage to the picture caused by ultraviolet light during display. The overcoat layer, formed of hardened cross-linked gelatin, also provides protection from the elements and from abrasive deterioration by contact which would cause scratching of a softer material.

Typical couplers suitable for the invention which form magenta dyes upon reaction with oxidized color developing agents are described in such representative patents and publications as: U.S. Pat. Nos. 2,600,788; 2,369,489; 2,343,703; 2,311,082; 3,152,896; 3,519,429; 3,062,653; 2,908,573, and "Farbkuppler-eine Literaturubersicht," published in Agfa Mitteilungen, Band III, pp. 126–156 (1961).

Couplers which form yellow dyes upon reaction with oxidized color developing agents are described in such representative patents and publications as: U.S. Pat. Nos. 2,875,057; 2,407,210; 3,265,506; 2,298,443; 3,048,194; 3,447,928; 5,021,333, and "Farbkuppler-eine Literaturubersicht," published in Agfa Mitteilungen, Band III, pp. 112–126.

In addition, other image couplers including the cyan couplers which can be useful are described in the patents listed in *Research Disclosure,* December, 1989, Item No. 308119, paragraph VII D, the disclosure of which is incorporated herein by reference.

Another key element to enhancing the useful lifetime of a color print is the reduction or elimination of the yellow stain which can form on prolonged exposure to light. This can be accomplished by coating a sufficient quantity of an ultraviolet light absorber (UVA) in the photographic element. Typically the UVA's are substituted phenylbenzotriazoles which are described in such representative patents as U.S. Pat. Nos. 4,853,471; 4,790,959; 4,752,298; 4,973,701; 4,383,863; 4,447,511; and references listed therein. Specific UVA's described in this invention are shown in structures V and U.

The examples below illustrate the formation of materials in accordance with the invention, as well as a comparison of the materials required for the conventional color paper materials. As the coupler materials and laydown techniques are those used conventionally in the art, a detailed disclosure of these techniques is not considered necessary.

EXAMPLE 1

The following material for backlight display was formed.

| | INVENTION | | |
|---|---|---|---|
| | g/m² Gel | g/m² Silver | g/m² Coupler |
| Overcoat | 1.35 | | |
| **UV Absorber | 0.70 | | |
| Cyan Layer | 2.20 | 0.57 | 0.93 |
| **UV Absorber | 0.7 | | |
| Magenta Layer | 2.65 | 0.68 | 0.97 |
| Interlayer | 0.75 | | |
| Yellow Layer | 2.84 | 0.60 | 1.86 |
| 27 g/m² Polyethylene Resin Layer | | | |
| *80 g/m² Paper Base | | | |
| 27 g/m² Polyethylene Resin Layer | | | |

*Hardwood fibers 0.5 to 0.7 weighted average fiber length.
**85 percent U and 15 percent V When exposed, conventionally developed and put in a backlighted display, this material gave a sharp, snappy, and brilliant picture.

EXAMPLES 2–4

The following Examples 2 and 3 are a comparison of a conventional Color Paper in Example 2, conventional emulsions on a low basis weight paper in Example 3, and the invention high coupler loaded emulsions on the thin basis weight paper in Example 4.

The three papers of Examples 2, 3, and 4 are exposed to the same negative, developed and placed in a backlighted display. Example 2 was dark and washed outlooking. Example 3 was washed out-looking with better whites than Example 2. Example 4 of the invention had good color saturation and good white reproduction. The white areas showed some paper structure when viewed up close. However, these materials are mainly used for distance viewing.

In Table 1 is a comparison of the Example 2–4 materials and "Duratrans" TM, a commercial polyester base material The table lists the $D_{min}$ and $D_{max}$ numbers for backlighted samples of each material. The difference is greatest for materials that have the best picture quality. The invention material of Example 4 surprisingly has performance similar to that of polyester transparent base material.

COMPARISON OF PAPER FORMATS
Major Components (g/m²)

| | Example 2 (Control) | | | Example 3 (Control) | | | Example 4 | | |
|---|---|---|---|---|---|---|---|---|---|
| | Gel | Silver | Coupler | Gel | Silver | Coupler | Gel | Silver | Coupler |
| Overcoat | 1.35 | | | 1.08 | | | 1.36 | | |
| **UV Absorber | 0.70 | | | 0.63 | | | 0.70 | | |
| Cyan Layer | 1.08 | 0.30 | 0.42 | 1.09 | 0.21 | 0.42 | 2.20 | 0.57 | 0.93 |
| **UV Absorber | 0.70 | | | 0.63 | | | 0.70 | | |
| Magenta Layer | 1.21 | 0.33 | 0.42 | 1.27 | 0.27 | 0.39 | 2.65 | 0.68 | 0.97 |
| Interlayer | 0.75 | | | 0.75 | | | 0.75 | | |

-continued

COMPARISON OF PAPER FORMATS
Major Components (g/m²)

| | Example 2 (Control) | | | Example 3 (Control) | | | Example 4 | | |
|---|---|---|---|---|---|---|---|---|---|
| | Gel | Silver | Coupler | Gel | Silver | Coupler | Gel | Silver | Coupler |
| Yellow Layer | 1.51 | 0.30 | 1.08 | 1.53 | 0.27 | 1.08 | 2.84 | 0.60 | 1.86 |
| Face Resin | | 25.90 | | | 27.37 | | | 27.37 | |
| Fiber Base | | 168.60 | | | 80.14 | | | 80.14 | |
| Wire Resin | | 27.85 | | | 29.32 | | | 29.32 | |

**85 percent U and 15 percent V

TABLE 1

| | $D_{min}$ | | | $D_{max}$ | | | Range | | |
|---|---|---|---|---|---|---|---|---|---|
| | Red | Green | Blue | Red | Green | Blue | Red | Green | Blue |
| Example 2 | .861 | .872 | .88 | 3.013 | 2.726 | 2.457 | 2.152 | 1.854 | 1.577 |
| Example 3 | 0.596 | 0.603 | .60 | 2.414 | 2.295 | 2.128 | 1.818 | 1.692 | 1.528 |
| Example 4 | 0.644 | 0.641 | .66 | 4.462 | 3.812 | 3.420 | 3.818 | 3.171 | 2.760 |
| Duratrans* | 0.360 | 0.381 | .53 | 4.011 | 3.289 | 3.417 | 3.651 | 2.908 | 2.887 |

*Trademark Eastman Kodak - Commercial polyester base backlight material

Materials Used in the Examples

Magenta Coupler

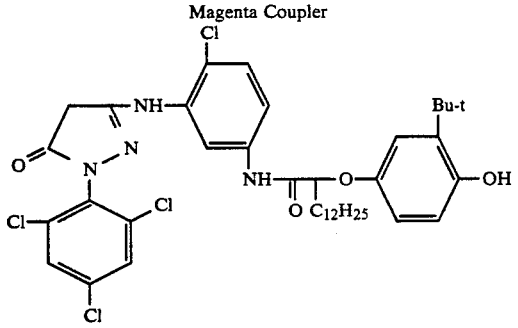

Yellow Coupler

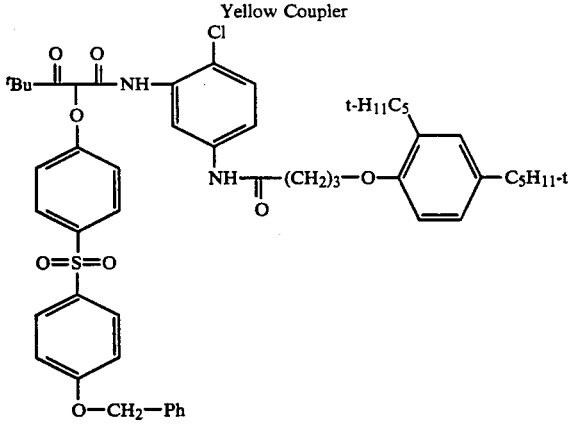

Cyan Coupler

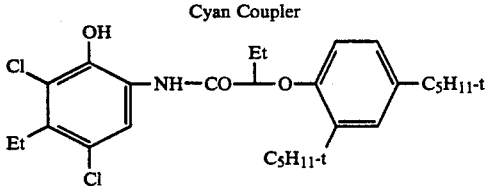

UV Absorbers (U)

-continued

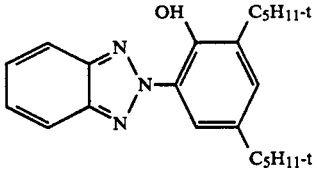

UV Absorbers (V)

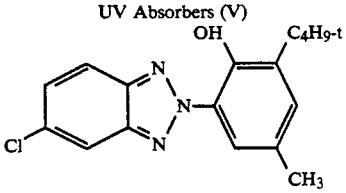

Magenta Stabilizer

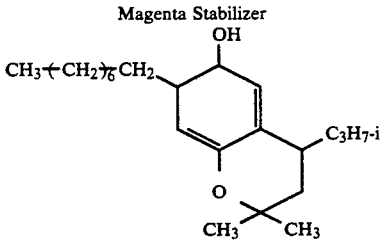

The invention has been described in detail with particular reference to preferred embodiments thereof, but it will be understood that variations and modifications can be effected within the spirit and scope of the invention.

We claim:

1. A translucent display material comprising a substrate and sensitized layers wherein said substrate comprises paper of a basis weight of less than 120 g/m², resin coated on both sides, and said sensitized layers comprise at least one layer comprising cyan dye-forming coupler, at least one layer comprising magenta dye-forming coupler, and at least one layer comprising yellow dye-forming coupler wherein said sensitized layers comprise magenta coupler at between about 0.7 and 1.5 grams per square meter, yellow dye-forming couplers at between 1.2 and 2.0 grams per square meter, and cyan dye-forming couplers at between the amount of 0.7 and 1.5 grams per square meter and wherein the white areas of said display material transmit greater than 17 percent of the light striking them.

2. The material of claim 1 wherein said paper has a basis weight between 70 and 100 g/m$^2$.

3. The material of claim 1 wherein said couplers are present in the following amounts:

cyan greater than 0.6 g/m$^2$
magenta greater than 0.6 g/m$^2$
yellow greater than 0.6 g/m$^2$.

4. The material of claim 1 wherein said paper is resin coated with polyethylene.

5. The material of claim 1 wherein said paper support contains optical brighteners and pigments.

6. The material of claim 1 wherein said display material when exposed and developed has a difference between maximum and minimum density of greater than 2.5.

7. The material of claim 1 wherein the light transmission is greater than 25 percent.

8. A translucent display material comprising a substrate and sensitized layers wherein said substrate comprises paper of a basis weight between 70 and 100 g/m$^2$, resin coated on both sides with a light transmission of greater than 25 percent and containing optical brighteners and pigments, said sensitized layers comprise at least one layer comprising cyan dye-forming coupler, at least one layer comprising magenta dye-forming coupler, and at least one layer comprising yellow dye-forming coupler, wherein said couplers are present in the following amounts:

cyan greater than 0.6 g/m$^2$
magenta greater than 0.6 g/m$^2$
yellow greater than 0.6 g/m$^2$, and the paper when exposed and developed has a difference between maximum density and minimum density of greater than 2.5.

9. The material of claim 8 wherein said paper is resin coated with polyethylene.

10. The material of claim 8 wherein said sensitized layers comprise magenta coupler at between about 0.7 and 1.5 grams per square meter, yellow dye-forming couplers at between 1.2 and 2.0 grams per square meter, and cyan dye-forming couplers at between the amount of 0.7 and 1.5 grams per square meter.

* * * * *